United States Patent [19]

McKiernan et al.

[11] Patent Number: 4,854,827

[45] Date of Patent: Aug. 8, 1989

[54] SANITARY PUMP STATION

[75] Inventors: Edward F. McKiernan, Wooster; James Sigler, Perrysville; Richard Sprang, Lakeville; Richard Lewellen; Mark Geis, both of Wooster, all of Ohio

[73] Assignee: Sealand Technology, Inc., Big Prairie, Ohio

[21] Appl. No.: 101,149

[22] Filed: Sep. 24, 1987

[51] Int. Cl.[4] ..... F04B 15/02

[52] U.S. Cl. ..... 417/313; 417/458; 417/900; 137/355.2; 4/323; 141/382; 242/86; 285/338

[58] Field of Search ..... 417/312, 456, 458, 900, 417/63, 413; 184/1.5; 137/355.2, 355.23; 4/321, 323; 141/382, 388, 389; 15/315; 242/86; 285/338, 346, 196

[56] References Cited

U.S. PATENT DOCUMENTS

| | | | |
|---|---|---|---|
| 2,279,156 | 4/1942 | Barks et al. | 137/355.2 X |
| 2,733,664 | 2/1956 | Saalfrank | 417/458 X |
| 3,048,428 | 8/1962 | Ransom | 285/338 X |
| 3,850,210 | 11/1974 | Buxton | 285/338 X |
| 4,012,002 | 3/1977 | McDonald et al. | 242/86 X |
| 4,107,860 | 8/1978 | Coggiola | 38/77.83 |
| 4,193,487 | 3/1980 | Takeuchi | 184/1.5 X |
| 4,257,748 | 3/1981 | Ives et al. | 417/63 |
| 4,305,553 | 12/1981 | Coquerel | 242/86 |
| 4,534,082 | 8/1985 | Piquin | 15/315 |
| 4,550,453 | 11/1985 | Norman | 4/323 |
| 4,649,954 | 3/1987 | Dunwoody | 242/86.5 R X |
| 4,669,145 | 6/1987 | Kehr | 15/315 X |
| 4,744,385 | 5/1988 | Houghton | 137/255 |

*Primary Examiner*—Carlton R. Croyle
*Assistant Examiner*—Eugene L. Szczecina, Jr.
*Attorney, Agent, or Firm*—Nixon & Vanderhye

[57] ABSTRACT

A sanitary pump station for removing waste from recreational vehicle and pleasure craft waste tanks is provided. A pump station housing encloses a motor driven pump provided with at least a pair of one-way valve arrangements in both inlet and outlets to the pump. A waste hose is connected to the pump inlet and stored on a reel device within the housing. A water hose connected to an external water source is also provided. The water hose is also stored in the housing on a second reel. The respective hoses may be pulled from the housing, selectively, and after use, may be rewound on the reels by a rewind mechanism selectively engageable with drive pulleys associated with the respective reels. A universal adaptor is also provided to enable connection between the waste hose and the termination valve of the waste tank.

22 Claims, 4 Drawing Sheets

FIG. 2
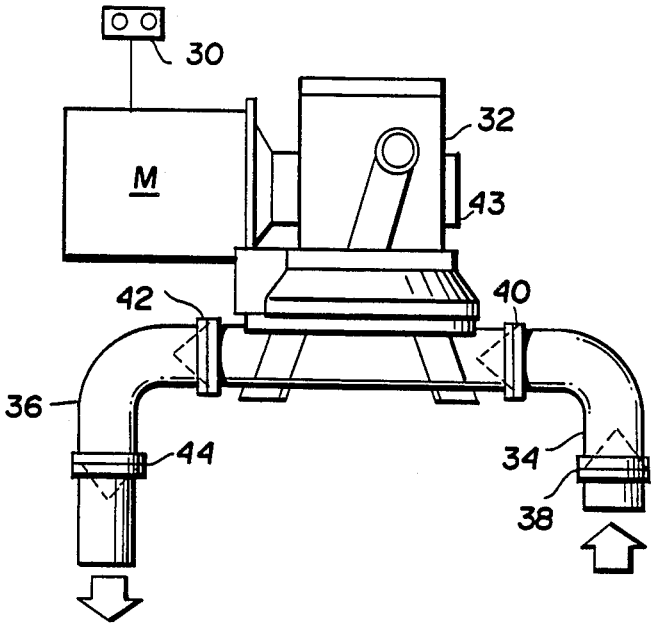
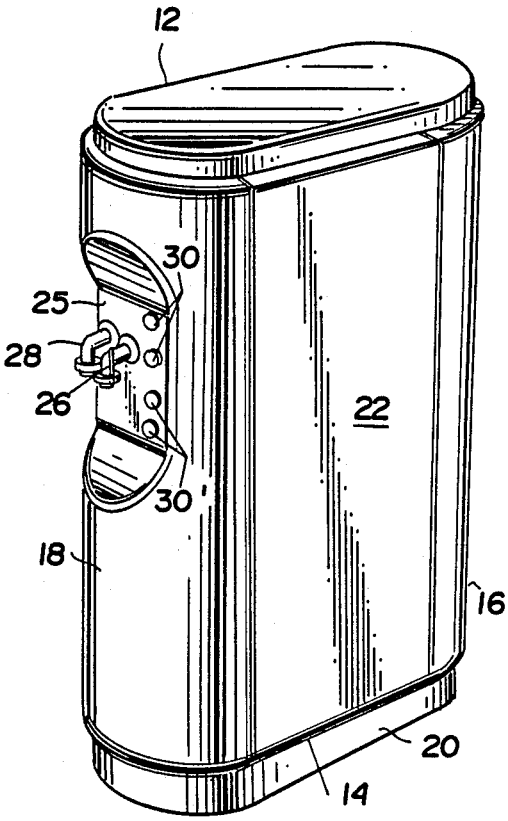
FIG. 1
10
FIG. 7
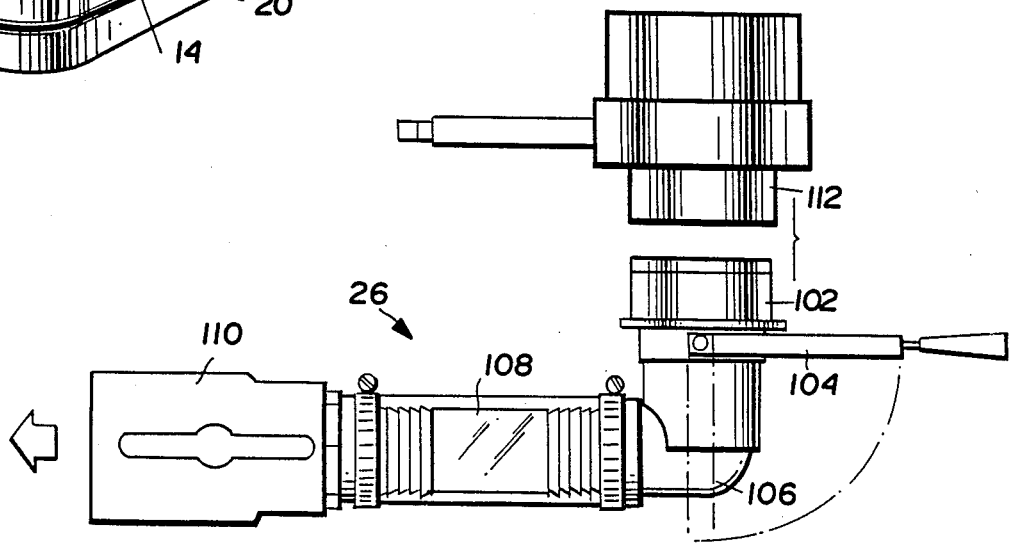

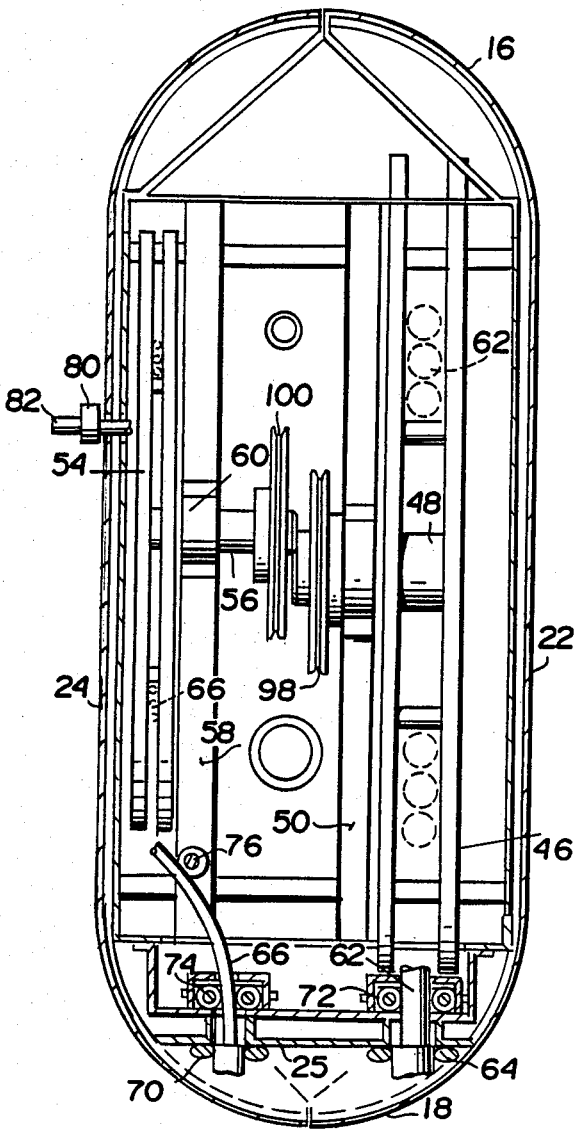
FIG. 4
FIG. 5
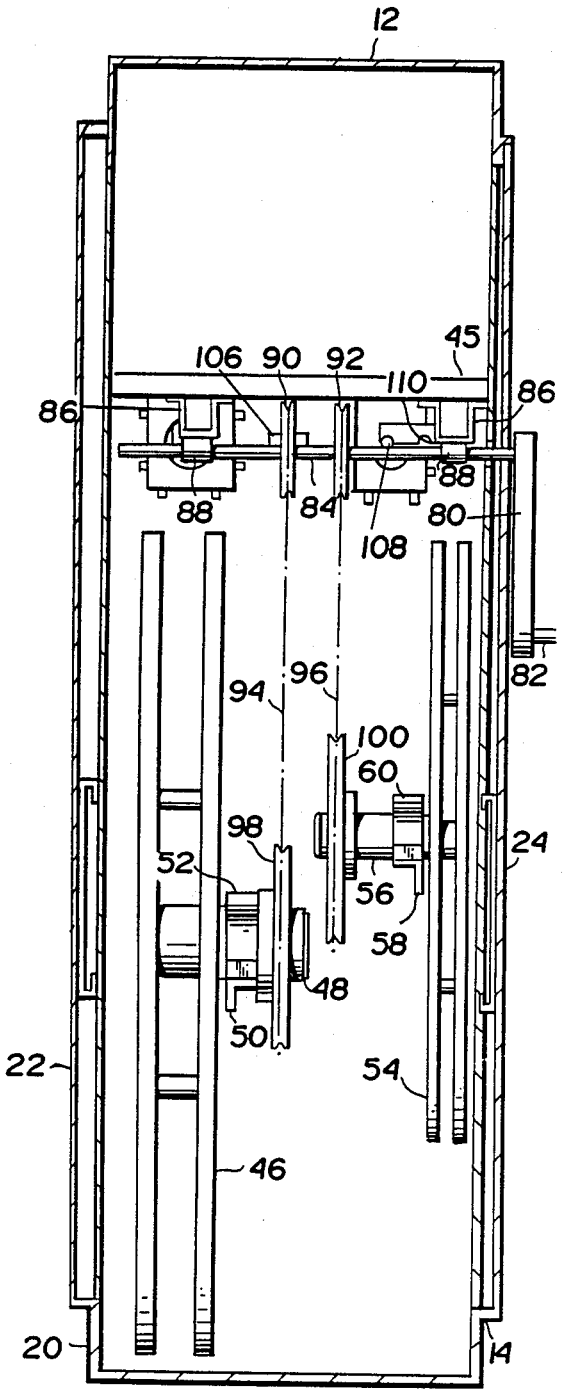

SANITARY PUMP STATION

BACKGROUND AND SUMMARY OF THE INVENTION

This invention relates to a sanitary pump station for emptying permanently installed waste tanks in recreational vehicles, pleasure craft and the like.

The pattern of recreational vehicle (or caravan) sales over recent years has shifted to larger, more luxurious vehicles. Sanitation systems in these units are likely to be permanently installed instead of the portable toilet type traditionally used. However, facilities for emptying permanently installed waste units are virtually nonexistent throughout many countries. One particularly unsatisfactory result of this situation is the increasingly common practice of slightly opening the termination valve of the sanitation system while traveling, allowing the tank contents to drip onto the roadbed.

A similar problem exists with respect to larger pleasure boats which often contain similar, permanently installed waste systems. While some of these systems incorporate waste treatment devices which permit dumping at sea, this is not a particularly desirable situation. Moreover, many boating sanitation systems do not include the waste treatment feature, and, as in the case of recreational vehicles, there are few marinas, docks, etc. which provide waste removal services and/or facilities.

This invention relates to a relatively simple but unique system for emptying on-board waste tanks of recreational vehicles, pleasure craft and the like. The system is specifically designed to provide land and water vehicle owners with a convenient and sanitary means of emptying on board waste tanks. In this regard, the system is ideally suited for installation in accordance with traffic patterns at gasoline stations, campgrounds, marinas, docks, etc.

The waste removal apparatus according to this invention is preferably enclosed in a vandal and weather resistant housing, somewhat similar in appearance to a conventional gasoline pump, and is capable of pumping waste tank contents almost any distance to a convenient sewer, septic tank or holding tank. The waste removal unit may also be operated by an attendant or by self-service with coin actuation or automatic timers.

In accordance with the present invention, the pump station housing encloses a discharge pump, a motor to drive the pump, and separate water and waste hoses stored on individual reels. In one exemplary embodiment of the invention, a heavy duty diaphragm pump is utilized in conjunction with a pair or more of conventional "duck bill" type valves on each side of the pump diaphragm housing. This feature eliminates a major problem caused by foreign materials lodging in conventional diaphragm pump flapper valves. In the valve design of the present invention, if one duck bill valve is held open, a second valve on the same side of the pump will keep the liquid flow moving.

The pump station of this invention also includes an attractive exterior housing design which will stand up to the stress of all weather exposure and demanding use. The housing is provided with large access door for maintenance purposes. In this regard, mounting connections, as well as electrical and sewer connections are enclosed within the housing to prevent vandalism. The housing also provides space for storage of water and waste hoses on reels internally mounted within the housing. The reels are selectively operable by a single exterior crank handle to rewind the hoses after use. The pump housing is also provided with heavy duty mounting feet for secure attachment to the facility.

The present invention also provides a universal adaptor for connecting the waste hose of the pump station to the termination valves of most standard recreational vehicles and pleasure craft. The separate water hose permits rinsing of the adjacent area around the waste tank and pump station.

The majority of waste tank termination valves used on European caravans, i.e., recreational vehicles, are of U.S. origin. In the U.S., over 95% of travel trailers and motor homes are equipped with permanently installed systems. The U.S. standard for termination valve design (ANSI 112.2) requires every valve be sold with a water tight cap and a 3" sewer hose adaptor.

Unfortunately the manufacturers of these fittings are not required to standardize the coupling system between the valve body and the hose adaptor. Normally this fact does not cause any difficulty because U.S. dumping facilities are designed to accept the 3" sewer hose. However, this is not the case in many other countries.

The present invention solves this problem by the use of a universal adaptor which includes a handle actuated, expandable rubber seal that is insertable in virtually any termination valve body presently in use.

A further feature of the present invention is that it is readily adaptable to attendant or self-service operations, with coin-operated and automatic turn-off features available for self-service applications.

In summary, it will be appreciated that the present invention is characterized by the following advantageous features:

(1) The discharge pump can handle foreign objects, particularly long, fibrous material, without clogging.
(2) The pump is able to run dry without harm.
(3) The housing is virtually vandal and weather proof.
(4) A single connecting device is provided which is simple and universally adaptable to virtually all termination valves presently in use on recreational vehicles and pleasure boats.
(5) A water hose may be provided, if permitted by local requirements, by which the exterior of the waste tank, the waste hose itself, and the area immediately adjacent the pump station may be rinsed.
(6) Controls allow attended or self-service operation.
(7) Hoses are constructed of strong, reinforced material so that large vehicles can run over them without damage.
(8) Maintenance costs are minimal and no special tools or training are required.

Other advantages will become apparent from the detailed description which follows.

BRIEF DESCRIPTION OF THE DRAWINGS

FIG. 1 is a perspective view of a sanitary pump station in accordance with the present invention;

FIG. 2 is a schematic view of a motor and pump in accordance with the invention;

FIG. 4 is a top view of the pump station shown in FIG. 3, with certain parts removed for clarity;

FIG. 5 is an end view of the pump station illustrated in FIG. 3, with certain parts removed for clarity;

FIG. 7 is an enlarged side view of a waste hose coupling incorporating a universal adaptor in accordance with the invention.

DETAILED DESCRIPTION OF THE INVENTION

Figure 3:
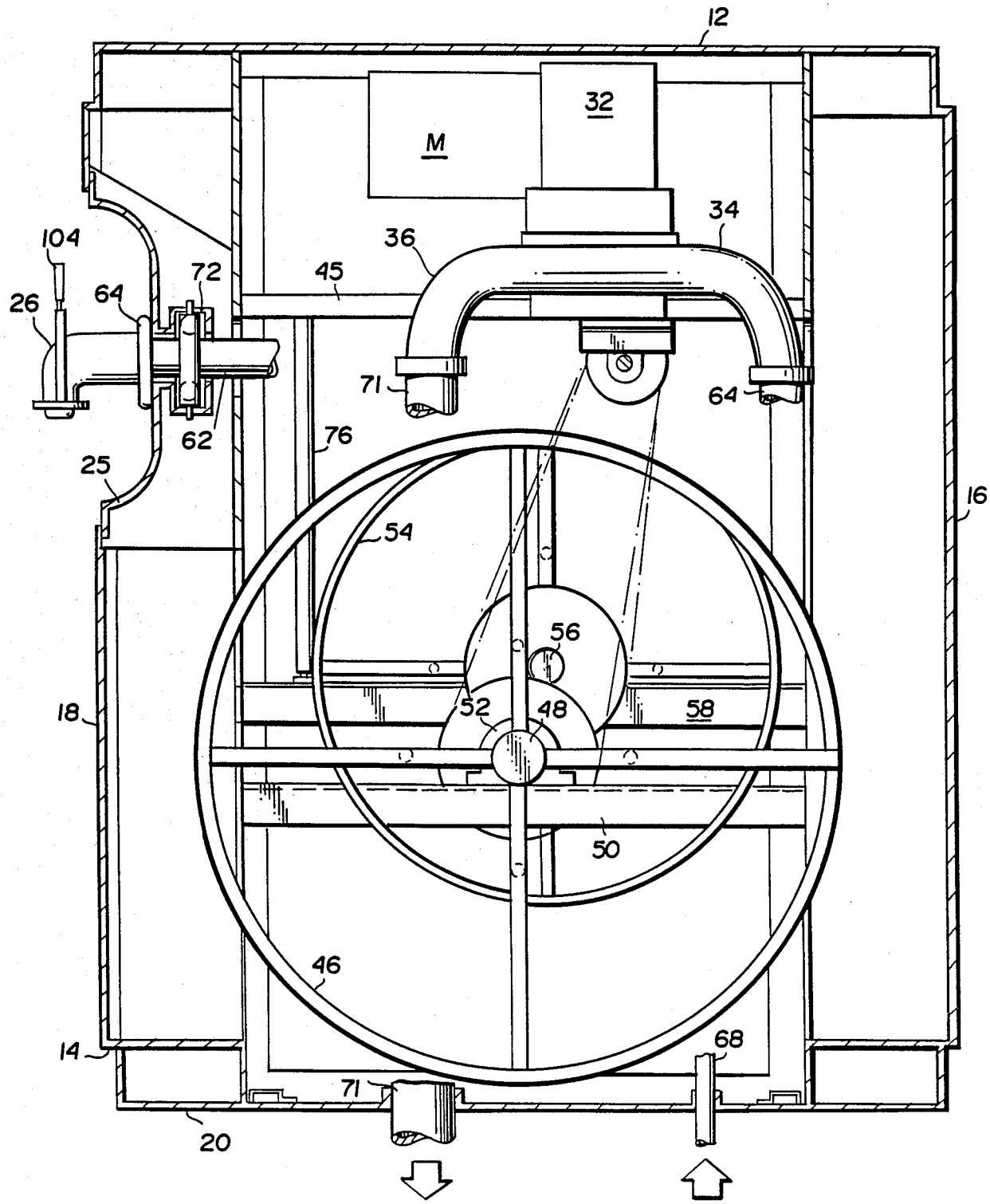
FIG. 3 is a side elevation, in partially schematic form, of the pump station illustrated in FIG. 1 with certain parts removed for clarity.

Referring now to FIG. 1, a pump station housing 10 includes a top wall 12, bottom wall 14, opposite end panels 16, 18 and opposing side plates 22, 24. The housing will typically be between four and five feet high, about four feet long and about one and one-half feet wide. The housing walls are preferably fabricated from 18 gauge, 300 series stainless steel with a brushed finish. Other weather resistant materials may be used as well. End panel 22, 24 is removable and serves as a maintenance door for accessing the interior of the housing. The manner in which panel 22, 24 is fastened to, and removed from, the remainder of the housing is within the skill of the art and need not be described further herein.

The lower base portion 20 encloses heavy duty mounting feet (not shown) by which the station housing may be secured to a suitable support surface, such as a concrete pad, wooden dock, or the like.

A control plate 25 overlies a cut-out portion of the housing end panel 18 and permits access to a waste hose coupling 26 and water hose nozzle 28. Either of the coupling or nozzle, to which waste and water hoses are respectively connected, may be pulled from the housing as explained in greater detail below.

On/off control buttons 30, 30' are also located on the plate 25 for controlling operation of the drive motor M, and the supply of fresh water, respectively. Alternatively, the supply of fresh water can be controlled manually by a valve located in the water hose nozzle.

With reference now to FIG. 2, there is schematically illustrated a motor M which drives a conventional positive displacement pump 32, preferably of the diaphragm type. The pump is connected to an inlet conduit 34 at one end, and an outlet conduit 36 at the other end. The pump inlet and outlet are each preferably on the order of 1½ inches in diameter. Within the inlet conduit, there are mounted a pair of conventional one-way duck bill valves 38,40. Similarly, on the outlet side of the pump, a pair of one-way duck bill valves 42, 44 are mounted within the conduit 36.

This unique double valve arrangement on each side of the pump assures pump operation even if one of the valves is held open by solid waste or other foreign material. It will be appreciated that three or more such valves may be used on either or both sides of the pump.

Capacity of the pump is approximately 16 gallons per minute at sea level with a suction lift of 15' and a static head of 15'. This is sufficient capacity to empty the average recreational vehicle craft waste holding tank in less than 3 minutes. Inlet and outlet piping are preferably 1½" in diameter. In this regard, the pump is able to handle solids up to two centimeters, but also foreign materials such as hose, sanitary napkins and rags without clogging.

The pump and valve housing are preferably constructed of naval bronze to prevent corrosion but other corrosion resistant materials may be employed.

A variety of motor configurations are available, and a heavy duty one inch speed reducer 43 may be employed. The motor and pump are mounted on a support plate 45 within the upper part of the housing as best seen in FIG. 3.

With further reference to FIGS. 3 through 5, the interior of the pump station housing 10 is shown to include an annular, open-frame waste hose reel 46 mounted for rotation on a shaft 48 which is, in turn, mounted on a angle-iron support bracket 50 via bearing block 52.

Similarly, a somewhat smaller diameter open-frame reel 54 for storing a water hose is provided, the reel mounted for rotation on a shaft 56 which, in turn, is mounted on another angle iron support bracket 58 via bearing block 60.

With reference to FIG. 4, it will be appreciated that the reel frame constructions are such as to present a winding surface which is only slightly larger than the diameter of the respective hoses. In other words, the reel 46 includes opposed annular frames 48' which are spaced apart a distance corresponding generally to the diameter of the waste hose 62. Similarly, reel 54 includes opposed annular frames 54' which are spaced apart a distance corresponding generally to the diameter of the water hose 66.

This arrangement confines both hoses to diametric spiral windings substantially in a single vertical plane, as best seen in FIG. 4. This is particularly advantageous in the case of waste hose 62 since waste material must flow through the partially wound hose in those instances where the vehicle waste tank is in close proximity to the pump station.

It will be understood, of course, that the manner in which reels 46 and 54 are mounted within the housing may vary, within the skill of the art.

The waste hose 62 is preferably steel-coil reinforced, and is preferably about 50 feet in length, and 1½ inches in diameter. This hose is connected at one end (adjacent the reel hub) via a conventional swivel coupling (not shown) to the inlet conduit 34 to the pump 32. The pump outlet 36 is connected to a pump discharge 71 conduit which exits the bottom of the housing and extends, underground to a sewer, or holding tank or the like. The other free, or outer, end of hose 62 is guided through an aperture in plate 25 where it is connected to coupling 26 and held there, by a rubber bushing 64 for example, for easy access by a user of the station.

The water hose 66, which is preferably about 30 feet in length, is connected at one end to a fresh water supply conduit 68, also by way of a rotary or swivel coupling (not shown). The outer, or free end of hose 66 is guided through another aperture in the plate 25 and is attached to a conventional nozzle 28 and held there by a rubber bushing 70. Nozzle 28 may also be provided with a manually operated valve to control the flow of water, as an alternative to the previously described control button 30'.

To facilitate unwinding of the hoses from the housing, hose guides 72 and 74, each of which may comprise a plurality of rollers, are provided adjacent the respective hose receiving apertures in plate 25.

Further, and as best seen in FIG. 4, because reel 54 is not aligned with the aperture in plate 25 for the water hose 66, a vertically and rotatably mounted guide roller 76 is provided to assure easy extension and retraction of the hose.

Figure 6:
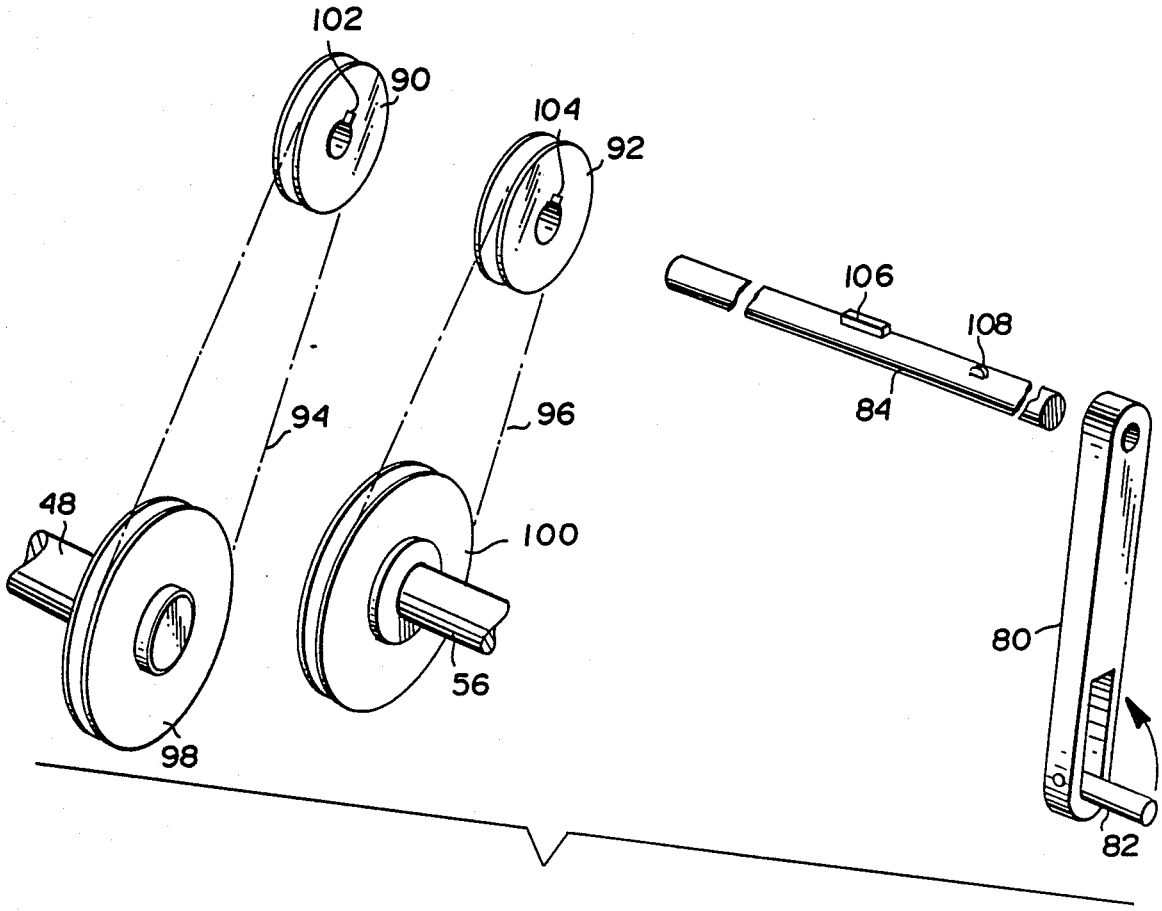
FIG. 6 is an exploded view of a hose rewind mechanism according to the invention.

With reference now to FIGS. 5 and 6, there will now be described a mechanism by which the water and/or waste hoses may be reeled back into the housing 10 after use. A crank 80, which includes a pivot handle 82 is mounted on a shaft 84, the crank and handle are accessible from outside the housing, adjacent side panel 24.

The shaft 84 is mounted within the housing by a pair of brackets 86, 86 and associated pillow blocks 88, 88. It is to be understood that the shaft is mounted for both axial as well as rotational movement. A pair of drive pulleys 90, 92 are mounted on shaft 84 for rotational movement relative to the shaft. Drive pulley 90 is operatively connected to a larger pulley 98 by means of a belt 94, while drive pulley 92 is operatively connected to a larger pulley 100 by means of a belt 96.

Pulley 98 is mounted on shaft 48 for rotation with reel 46. In a similar manner, pulley 100 is mounted on shaft 56 for rotation with reel 54.

Drive pulley 90 is provided with a keyway 102, while drive pulley 92 is provided with a similar keyway 104. Shaft 84 is provided with a key 106 which is adapted to fit within either of keyways 102 or 104.

It may now be understood that when crank 80 and shaft 84 are pushed inwardly (toward the housing) to a first operative position, key 106 will engage keyway 102 so that, upon subsequent rotation of the shaft 84, effected by the pump station user grasping handle 82, the waste hose 62 may be rewound on the reel 46.

If, on the other hand, the user pulls crank 80 and shaft 84 outwardly (away from the housing) to a second operative position, key 106 will disengage keyway 102 and engage keyway 104 so that subsequent rotation of crank 80 and shaft 84 will effect rewinding of the water hose 66.

In order to indicate to the user in a more positive manner when the shaft is in its first or second operative positions, a ball and detent mechanism 108, 110 may be employed, with a ball 108 resiliently mounted in shaft 84 and a detent bracket 110 fixed to the housing. The detents, of course, are to be axially spaced a distance corresponding to the travel of key 106 between keyways 102 and 104.

It will be appreciated that belts 94, 96 may be of the V-belt type typically used in vehicle fan belts. However, other constructions may also be employed. For example, pulleys 90, 92, 98 and 100 may be in the form of sprockets, and belts 94, 96 may be in the form of chains.

In addition, it will be appreciated that reel shafts 48 and 56 may be journaled within bearing blocks so that the shaft rotate with the reels or, in the alternative, shafts 48 and 56 may be stationarily mounted, with reels 48, 56 mounted, as by roller bearings, for rotation on the respective shafts. In either case, pulleys 98 and 100 must be appropriately mounted for rotation with the reels 46, 54, respectively.

It is also within the scope of this invention to unwind and rewind the waste and water hoses by means of one or more electric motors which would be operatively connected to the drive shaft 84.

Turning now to FIG. 7, there is illustrated an enlarged view of coupling 26 which includes a universal adaptor designed to permit connection of the waste hose 62 to virtually any termination valve presently in use on recreational vehicles, pleasure craft, and the like. The coupling comprises a right-angle configuration which includes a universal adaptor in the form of a conventional expandable rubber seal 112 actuated by handle 104, an elbow 106, a sight tube 118 and a ball valve 110.

The expandable seal 112 is adapted for insertion within a termination valve 112, typically three inches in diameter, but as previously stated, the sewer hose adaptor associated with such valves are generally not standardized. The expandable rubber seal 112 of this invention is thus designed to effect a water tight seal with the valve 112. After insertion of the seal, handle 114 is rotated to cause seal 112 to expand radially (by any suitable means) into engagement with the inner wall of the termination valve. After the vehicle tank has been emptied, (which is observed by the user via sight tube 108) the handle may be rotated in an opposite direction, to retract the seal and allow removal of the coupling.

It is also a feature of this invention that the coupling 26 include a conventional one way ball or check valve 110 to prevent waste within the waste hose from escaping once the hose is disconnected from the termination valve.

In operation, a recreational vehicle operator will drive the vehicle into the proximity of a pump station 10, which, if desired, can be suitably labelled to indicate the general function of the station, and including directions on how to use if the station is designed for self-service with coin actuation, etc.

With the crank 80 in a neutral position, i.e., with key 106 between keyways 102 and 104, the waste hose coupling 26, may be pulled from the housing while unwinding from the reel 46. It will be appreciated that reel 46 may be provided with a conventional friction brake or other suitable means to control the momentum of the reel as it is being unwound. The brake would also be effective upon rewinding of the hose, again, to prevent undesirable build up of momentum in the reel. Upon extending the waste hose 62, the user inserts the expandable seal 112 of the coupling 26 into the waste tank termination valve 122, being sure to rotate the handle 114 into a sealing position. In this regard, a conventional over-center arrangement may also be provided in the pivoting motion of the handle to assure tight sealing engagement between the adaptor and termination valve.

The user then pushes the "on" button of the control buttons 30 mounted on plate 25 to commence pumping of waste which flows through waste hose 62, pump 32, discharge conduit 71 and suitable underground piping to a main sewer line, holding tank, or the like. When the tank is emptied, the user turns the pump off via controls 30 and rotates handle 114 to release the expandable seal 112 from the termination valve 122. Thereafter, crank 80 is pushed inwardly to its first operative position to engage key 106 with keyway 102. Handle 82 is then employed to rewind the waste hose 62 on reel 46.

It will be understood that fresh water hose 66 may be used to rinse the exterior of the waste tank, the waste hose 62 and/or the area immediately adjacent the pump station if so desired. Hose 66 may thereafter be rewound by pulling crank 80 to its outer, second operative position and rotating the crank via handle 82.

A similar waste tank disposal process would be carried out by boat operators at marinas or docks provided with pump stations in accordance with the invention.

It will thus be appreciated that the present invention provides a relatively simple and convenient manner in which to dispose of recreational vehicle, or pleasure craft, waste in a sanitary manner.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A sanitary pump station for emptying vehicle waste tanks comprising:

a housing adapted to be mounted on a support surface;

pump means enclosed within said housing, said pump including an inlet, an outlet, and means for driving said pump, wherein each of said inlet and outlet is provided with at least two one way duck bill valves;

waste hose means for connection between said pump inlet and termination valve means associated with a vehicle waste tank; and wherein said housing is further provided with a water hose connected to an external water supply for rinsing said vehicle waste tank after it is emptied.

2. A sanitary pump station according to claim 1 wherein said waste hose and said water hose are wound on first and second reels, respectively, mounted within said housing.

3. A sanitary pump station according to claim 2 wherein at least said first reel includes means for confining said waste hose to diametric spiral winding substantially in a single plane.

4. A sanitary pump station according to claim 2 wherein each of said first and second reels includes means for confining said waste and water hoses, respectively, to diametric spiral winding substantially in a single plane.

5. A sanitary pump station according to claim 2 wherein means are provided by which said waste hose and said water hose may be selectively unwound from said reels from outside said housing.

6. A sanitary pump station according to claim 5 wherein said housing includes means for selectively rewinding said waste hose and said water hose on said reels.

7. A sanitary pump station according to claim 6 wherein said rewinding means includes a single crank provided with means for selectively engaging drive pulleys associated with each of said reels.

8. A sanitary pump station according to claim 1 wherein said station further includes a universal adaptor provided with a handle actuator for connecting said waste hose means to said termination valve means.

9. A sanitary pump station according to claim 8 wherein said handle actuated adaptor includes an expandable rubber seal adapted for placement within said termination valve means.

10. A sanitary pump station according to claim 9 wherein said handle actuated adaptor includes means for expanding said rubber seal radially outwardly into engagement with said termination valve means.

11. A sanitary waste pumping station for removing waste from a tank comprising:

a housing;

a pump enclosed within said housing, said pump having an inlet and an outlet;

a motor for driving said pump mounted within said housing adjacent said pump;

a waste hose connected at one end to the inlet of said pump, the other end of said waste hose being accessible from outside said housing;

a pump discharge conduit connected to the outlet of the pump and extending out of the housing;

rotatable means within said housing for storing said waste hose;

means permitting said waste hose to be unwound from said rotatable means within housing; and means for rewinding said waste house on said rotatable storing means, and wherein guide means are provided on said housing for facilitating the winding and unwinding of said waste hose.

12. A waste pumping station according to claim 11 wherein said rotatable storing means includes a first reel and a first pulley mounted for rotation therewith.

13. A waste pumping station according to claim 12 wherein said rewinding means includes an actuator connected to a drive shaft, said drive shaft mounting a second pulley for rotation relative to said shaft, said first and second pulleys connected by a first flexible drive belt.

14. A waste pumping station according to claim 13 wherein said drive shaft includes means selectively engageable with said second pulley.

15. A waste pumping station according to claim 14 wherein said housing includes a second reel mounted adjacent said first reel, said second reel supporting a flexible water supply hose, said water supply hose connected at one end to a water supply source, the other, free end of said water supply hose being accessible from outside said housing.

16. A waste pumping station according to claim 15 wherein said second reel has a third pulley mounted for rotation with said second reel;

said drive shaft mounting a fourth pulley for rotation relative to said shaft, said third and fourth pulleys connected by a second flexible drive belt.

17. A waste pumping station according to claim 16 wherein said selectively engageable means comprises a key mounted on said shaft, and wherein said second and fourth pulleys are each provided with a keyway adapted to receive said key.

18. A waste pumping station according to claim 17 wherein said drive shaft is movable axially between a first operative position wherein said key is received in said keyway provided in said second pulley, whereby said drive shaft may be rotated by said actuator to rewind said waste hose on said first reel, and a second operative position wherein said key is received in said keyway provided in said fourth pulley, whereby said actuator may be rotated to rewind said water supply hose.

19. A waste pumping station according to claim 11 wherein said pump comprises a positive displacement pump and wherein at least a pair of one-way valves are located in the inlet to said pump.

20. A waste pumping station according to claim 19 wherein at least a pair of one-way valves are located in an outlet of said pump.

21. A waste pumping station according to claim 20 wherein said one-way valves are duck bill-type valves.

22. A sanitary pump station for emptying vehicle waste tanks comprising:

a housing adapted to be mounted on a support surface;

pump means enclosed within said housing, said pump including an inlet, an outlet, and means for driving said pump, wherein each of said inlet and outlet is provided with a plurality of one way valve means;

a waste hose wound on a first reel for connection between said pump inlet and termination valve means associated with a vehicle waste tank;

a water hose wound on a second reel an connected to an external water supply for rinsing said vehicle waste tank after it is emptied;

wherein said first and second reels are mounted within said housing and wherein means are provided by which said waste hose and said water hose may be selectively unwound and rewound from outside said housing, and further wherein said means includes a single crank provided with means for selectively engaging drive pulleys associated with each of said reels.

* * * * *